US010746078B2

(12) United States Patent
Kim et al.

(10) Patent No.: US 10,746,078 B2
(45) Date of Patent: Aug. 18, 2020

(54) EXHAUST SOUND GENERATING APPARATUS OF VEHICLE

(71) Applicants: HYUNDAI MOTOR COMPANY, Seoul (KR); KIA Motors Corporation, Seoul (KR)

(72) Inventors: Keonwoo Kim, Seoul (KR); HyunWoo Yoon, Suwon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 359 days.

(21) Appl. No.: 15/820,623

(22) Filed: Nov. 22, 2017

(65) Prior Publication Data

US 2019/0063297 A1 Feb. 28, 2019

(30) Foreign Application Priority Data

Aug. 25, 2017 (KR) ..... 10-2017-0107889

(51) Int. Cl.

| | |
|---|---|
| ***F01N 13/00*** | (2010.01) |
| ***F01N 13/08*** | (2010.01) |
| ***F01N 13/18*** | (2010.01) |
| ***F01N 1/02*** | (2006.01) |
| ***F01N 1/06*** | (2006.01) |

(52) U.S. Cl.

CPC ..... *F01N 13/001* (2013.01); *F01N 1/02* (2013.01); *F01N 1/06* (2013.01); *F01N 13/08* (2013.01); *F01N 13/1805* (2013.01); *F01N 2490/14* (2013.01)

(58) Field of Classification Search

CPC ..... F01N 13/08; F01N 13/1805; F01N 1/02; F01N 1/06; F01N 13/001; F01N 2490/14

USPC ..... 181/228, 175

See application file for complete search history.

(56) References Cited

U.S. PATENT DOCUMENTS

| | | | | |
|---|---|---|---|---|
| 4,860,853 | A * | 8/1989 | Moring, III | F01N 1/02 181/282 |
| 5,229,556 | A | 7/1993 | Geddes | |
| 7,441,527 | B2 * | 10/2008 | Hayashi | F02B 33/44 123/184.53 |
| RE42,490 | E * | 6/2011 | Takeuchi | F02M 35/10295 123/184.53 |
| 8,177,022 | B2 * | 5/2012 | Honji | G10K 11/22 181/175 |
| 8,322,486 | B2 * | 12/2012 | Ohta | F02M 35/1294 123/184.57 |

(Continued)

FOREIGN PATENT DOCUMENTS

| | | |
|---|---|---|
| JP | 2017-021348 A | 1/2017 |
| KR | 10-1144465 B1 | 5/2012 |

(Continued)

*Primary Examiner* — Forrest M Phillips

(74) *Attorney, Agent, or Firm* — McDonnell Boehnen Hulbert & Berghoff LLP

(57) ABSTRACT

Disclosed is an exhaust sound generating apparatus of a vehicle including a housing which has a connection flow passage connected to the exhaust pipe of a vehicle and is open on one surface, a cover member covering the open portion of the housing, and a membrane accommodated in an inside of the housing to partition the inside of the housing into a first space on the connection flow passage side and a second space on the cover member side and vibrated by the pulsation of exhaust gas.

9 Claims, 6 Drawing Sheets

(56) References Cited

U.S. PATENT DOCUMENTS 8,634,574 B2 * 1/2014 Mah ..... B60R 13/08 123/184.53
9,066,168 B2 6/2015 Peitz et al.
9,206,717 B2 12/2015 Kruger et al.
9,909,545 B1 * 3/2018 Waisanen ..... F02M 35/10242
10,436,085 B2 * 10/2019 Pompucci ..... F01N 1/166
2002/0157897 A1 * 10/2002 Hofmann ..... F02B 77/13 181/214
2005/0121254 A1 * 6/2005 Hofmann ..... F01N 13/00 181/237
2005/0121255 A1 * 6/2005 Hofmann ..... G10K 11/22 181/250
2005/0121256 A1 * 6/2005 Hofmann ..... G10K 9/02 181/271
2005/0133300 A1 * 6/2005 Hofmann ..... G10K 11/22 181/250
2006/0283658 A1 * 12/2006 Abe ..... F02M 35/10137 181/204
2007/0277768 A1 * 12/2007 Takeuchi ..... F02M 35/1272 123/184.57
2008/0017440 A1 * 1/2008 Seko ..... F02M 35/1255 181/175
2008/0053747 A1 * 3/2008 Krueger ..... F01N 1/065 181/206
2009/0057054 A1 * 3/2009 Kostun ..... F02B 33/44 181/206
2012/0261210 A1 * 10/2012 Kondou ..... F01N 1/023 181/228
2017/0350287 A1 * 12/2017 Pompucci ..... F01N 13/04

FOREIGN PATENT DOCUMENTS

KR 10-1349600 B1 1/2014
KR 10-2014-0021425 A 2/2014

* cited by examiner

EXHAUST SOUND GENERATING APPARATUS OF VEHICLE

CROSS-REFERENCE TO RELATED APPLICATION(S)

This application claims the benefit of Korean Patent Application No. 10-2017-0107889, filed on Aug. 25, 2017 in the Korean Intellectual Property Office, the entire contents of which is fully incorporated by reference herein.

BACKGROUND

1. Technical Field

The present disclosure relates to an exhaust sound generating apparatus of a vehicle which is installed on an exhaust path of a vehicle to generate a sporty exhaust sound.

2. Description of the Related Art

Typical vehicles focus on reducing the exhaust sound. However, vehicles that enjoy dynamism, such as sports cars, are equipped with an exhaust sound generating apparatus that generate dynamic and sporty exhaust sounds during acceleration.

A conventional exhaust sound generating apparatus generates an exhaust sound by using the pulsation pressure of exhaust gas. The exhaust sound generating apparatus includes a housing provided on an exhaust pipe so that the inner space thereof communicates with an exhaust path of the exhaust pipe, and a membrane coupled to the housing in an exposed state on one side thereof and generating a sporty exhaust sound by being vibrated by the pulsating pressure of exhaust gas.

However, in such an exhaust sound generating apparatus, when the RPM of an engine increases due to rapid acceleration or the like, the vibration of the membrane is also increased, and the exhaust sound may become too large because the membrane is exposed to the outside. In addition, a heterogeneous sound is generated in a high frequency band and the exhaust sound may be heard roughly.

In addition, since a conventional exhaust sound generating apparatus has a structure in which the membrane is exposed, the entire circumference of the membrane coupled to the housing is welded and sealed, so that the vibration of the membrane may change depending on the quality of the welding. If the welding around the membrane is uneven, the membrane may be deformed, and the deformation of the membrane may change the vibration, resulting in a defective exhaust sound. The exposed membrane also has drawbacks that is susceptible to deformation by external impact and is vulnerable to corrosion.

SUMMARY

It is an aspect of the present disclosure to provide an exhaust sound generating apparatus of a vehicle which is capable of preventing an excessive increase in exhaust sound even when the vibration of a membrane is instantaneously increased, and is capable of preventing a heterogeneous sound from being generated in a high frequency band.

It is another aspect of the present disclosure to provide an exhaust sound generating apparatus of a vehicle which is capable of preventing a deformation of a membrane to generate a good exhaust sound, and is capable of preventing the membrane from corrosion or external impact.

Additional aspects of the present disclosure will be set forth in part in the description which follows and, in part, will be obvious from the description, or may be learned by practice of the disclosure.

In accordance with one aspect of the present disclosure, there may be provided an exhaust sound generating apparatus of a vehicle including a housing which has a connection flow passage connected to the exhaust pipe of a vehicle and is open on one surface, a cover member covering the open portion of the housing, and a membrane positioned in an inside of the housing to partition the inside of the housing into a first space on the connection flow passage side and a second space on the cover member side, and vibrated by the pulsation of exhaust gas.

The housing may include a bottom portion provided with the connection flow passage and a side surface portion bent and extended toward the cover member from a circumference of the bottom portion.

The membrane may include a fixing portion coupled to a corresponding inner surface of the side surface portion of the housing and fixed to the inner surface of the side surface portion of the housing by spot welding at a plurality of points.

The cover member may include a first cover part covering the open portion of the housing and having a first circumferential portion that is inserted into an inside of the side surface portion of the housing and coupled to the housing, and a second cover part covering an outside of the first cover part so as to form a space with the first cover part and having a second circumferential portion coupled to the outside of the first circumferential portion.

The fixing portion of the membrane may be spaced apart from the first circumferential portion, and the side surface portion of the housing may be welded to an outer surface of the first circumferential portion of the first cover part in a state of being spaced apart from the second circumferential portion.

The second circumferential portion may be fixed to the first circumferential portion by spot welding at a plurality of points.

The exhaust sound generating apparatus of a vehicle may further include at least one fixing member for connecting and fixing the bottom portion of the housing to the exhaust pipe.

BRIEF DESCRIPTION OF THE DRAWINGS

Exemplary aspects are illustrated in the drawings. It is intended that the embodiments and figures disclosed herein are to be considered illustrative rather than restrictive.

DETAILED DESCRIPTION

Hereinafter, embodiments of the present disclosure will be described in detail with reference to the accompanying drawings. The following embodiments are provided to fully convey the spirit of the present disclosure to a person having ordinary skill in the art to which the present disclosure belongs. The present disclosure is not limited to the embodiments shown herein but may be embodied in other forms. The drawings are not intended to limit the scope of the present disclosure in any way, and the size of components may be exaggerated for clarity of illustration.

Figure 1:
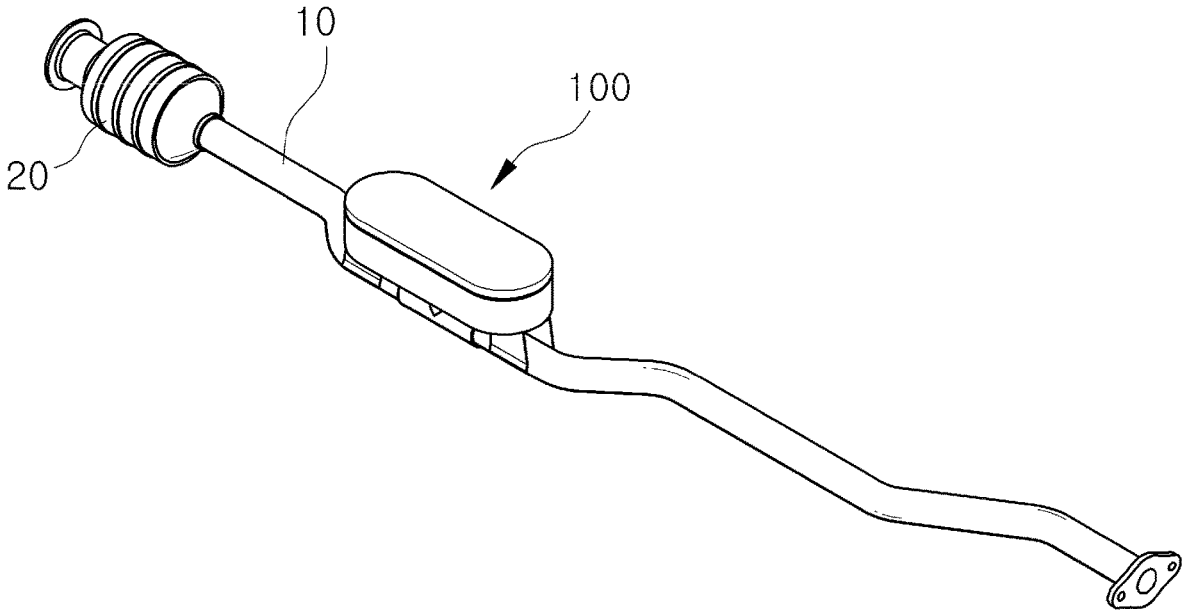
FIG. 1 illustrates an exhaust system of a vehicle equipped with an exhaust sound generating apparatus according to an embodiment of the present disclosure.

FIG. 1 illustrates an exhaust system of a vehicle equipped with an exhaust sound generating apparatus according to an embodiment of the present disclosure. As shown in FIG. 1, the exhaust system of a vehicle includes an exhaust pipe 10 connected to an exhaust manifold (not shown) of an engine, a muffler 20 mounted on the exhaust pipe 10, and an exhaust sound generating apparatus 100 mounted on the exhaust pipe 10 in order to generate a sporty exhaust sound. The muffler 20 reduces the temperature and the pressure before releasing the high-temperature and high-pressure exhaust gas discharged from the engine to the atmosphere, thereby preventing the occurrence of explosive sounds.

Figure 2:
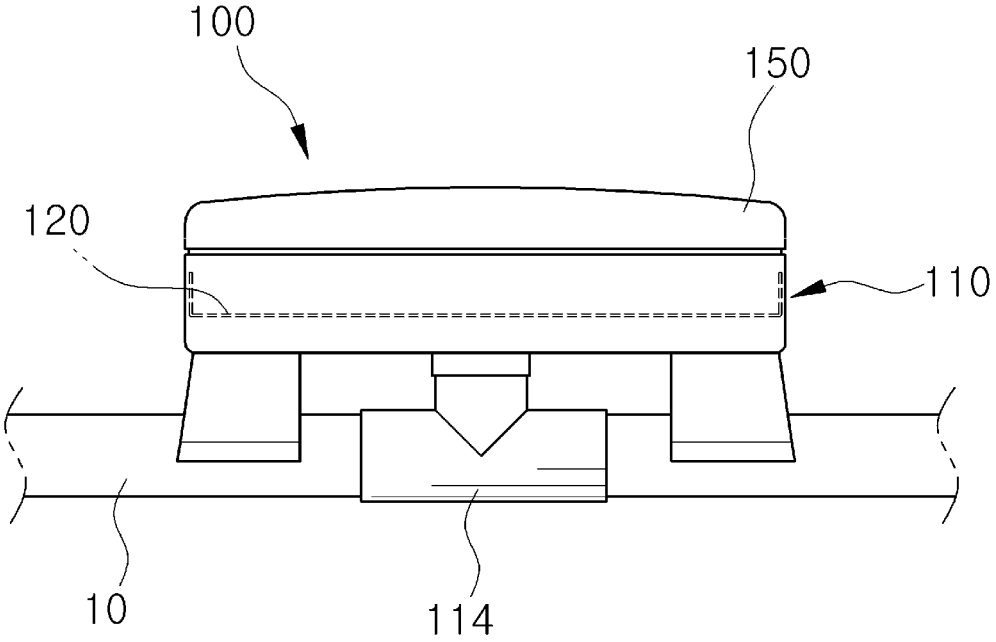
FIG. 2 is a side view of an exhaust sound generating apparatus according to an embodiment of the present disclosure.
Figure 3:
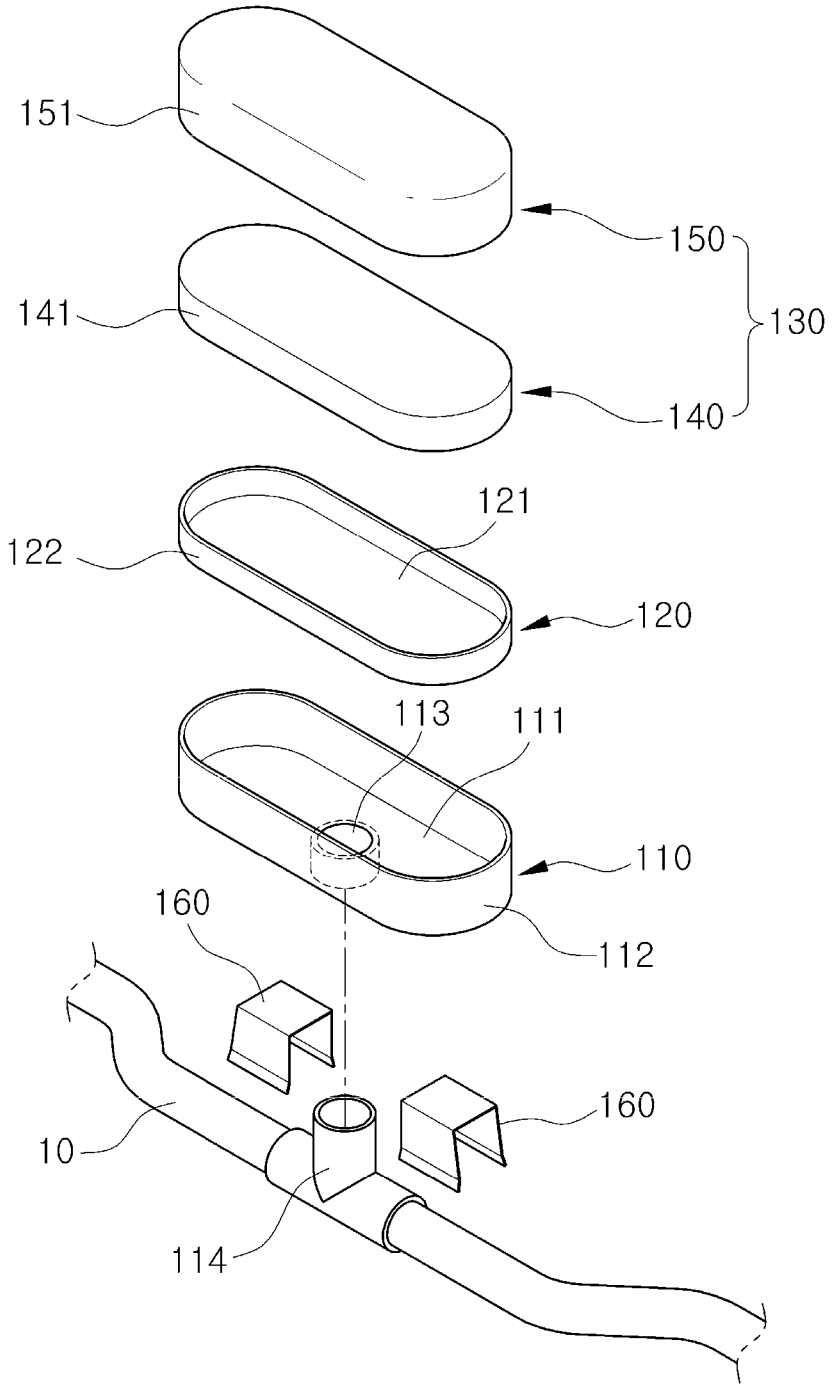
FIG. 3 is an exploded perspective view of an exhaust sound generating apparatus according to an embodiment of the present disclosure.
Figure 4:
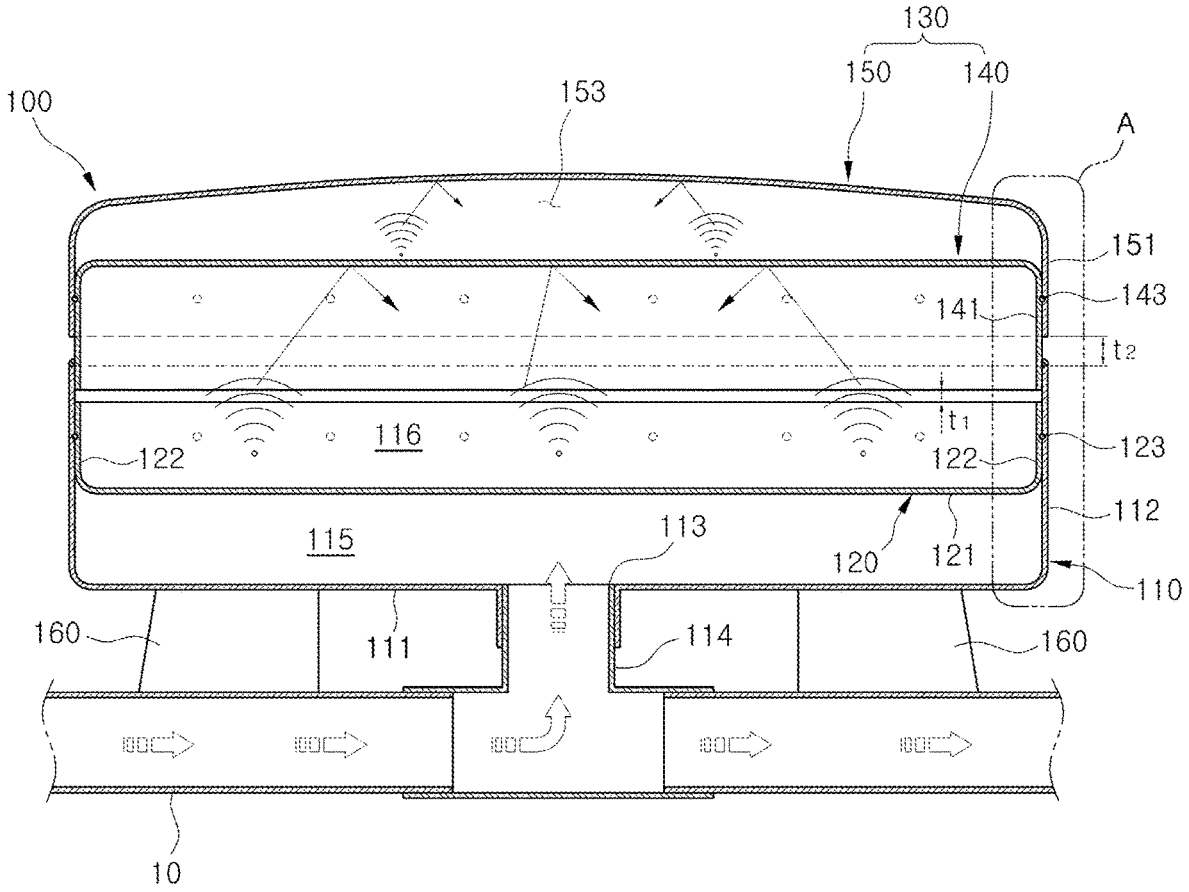
FIG. 4 is a cross sectional view of an exhaust sound generating apparatus according to an embodiment of the present disclosure.

FIGS. 2 to 4 are a side view, an exploded perspective view and a cross sectional view of the exhaust sound generating apparatus, respectively.

Referring to FIGS. 2 to 4, the exhaust sound generating apparatus 100 includes a housing 110 which has a connection flow passage 113 connected to the exhaust pipe 10 of a vehicle and is open on one surface. The apparatus 100 further includes a cover member 120 covering and sealing the open portion of the housing 110. Additionally, the apparatus 100 includes a membrane 120 accommodated in an inside of the housing 110 to partition the inside of the housing 110 into a first space 115 on the connection flow passage 113 side and a second space 116 on the cover member 130 side and vibrated by the pulsation of exhaust gas.

The housing 110 includes a bottom portion 111 provided with the connection flow passage 113, and a side surface portion 112 bent toward the cover member 130 from the entire circumference of the bottom portion 111 and then extended to a predetermined width. The housing 110 may have a long rectangular shape, and opposite sides of the side surface portion 112 may be curved. Herein, the housing 110 is presented as an example only, and the shape of the housing is not limited thereto.

The connection flow passage 113 of the housing 110 may be provided in the middle of the bottom portion 111. The connection flow passage 113 is connected to a T-shaped connection pipe 114 provided in the exhaust pipe 10 so that the inside of the housing 110 can communicate with a flow passage of the exhaust pipe 10.

Figure 5:
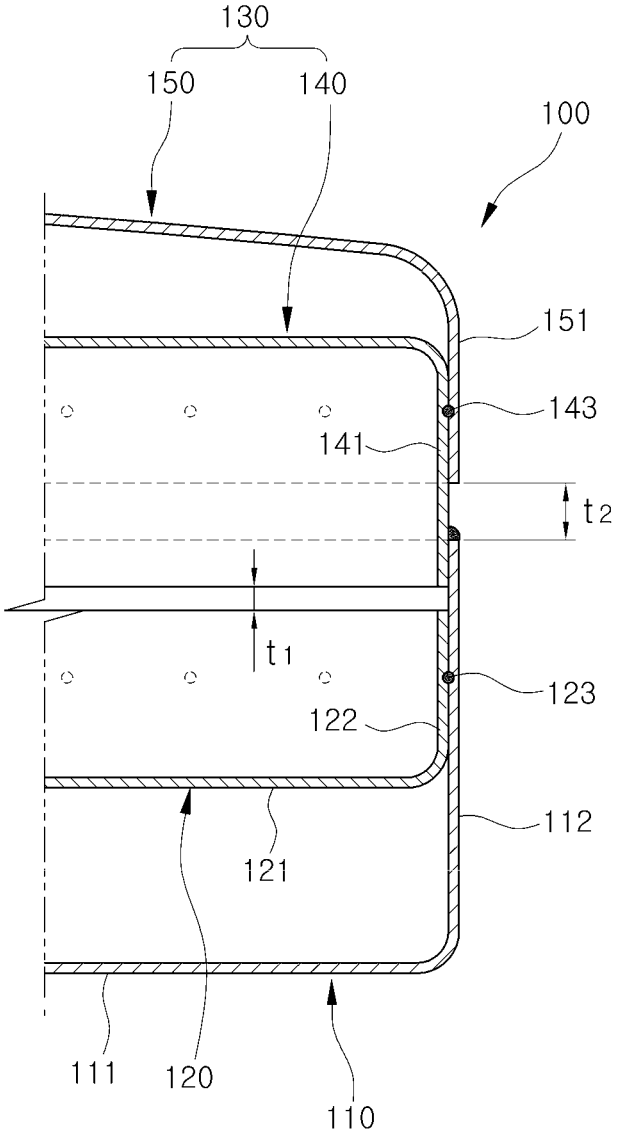
FIG. 5 is a detailed view of 'A' portion in FIG. 4.

The membrane 120 has a flat plate portion 121, and a fixing portion 122 that is bent at a circumference of the flat plate portion 121 and coupled to the corresponding inner surface of the side surface portion 112 of the housing 110. As shown in FIG. 5, the fixing portion 122 of the membrane 120 may be fixed to the inner surface of the side surface portion 112 of the housing 110 by spot welding at a plurality of points in a state of being inserted into the side surface portion 112 of the housing 110. A plurality of spot welded portions 123 may be spaced apart from each other at equal spacing.

Since the fixing portion 122 of the membrane 120 is fixed by spot welding, the membrane 120 can be quickly fixed to the inside of the housing 110, and the plate portion 121 can be prevented from being deformed by welding heat. That is, the flat plate part 121 of the membrane 120 can be prevented from being deformed by welding heat in the process of installing the membrane 120. Accordingly, the membrane 120 can generate a good exhaust sound regardless of the welding state.

The cover member 130 may include a first cover part 140 and a second cover part 150. The first cover part 140 covers the open portion of the housing 110 and has a first circumferential portion 141 which is inserted into the inside of the side surface portion 112 of the housing 110 and is coupled to the side surface portion 112 of the housing 110. The second cover part 150 covers the outside of the first cover part 140 so as to form a space 153 between the first cover part 140 and the second cover part 150, and has a second circumferential portion 151 coupled to the outside of the first circumferential portion 141.

The first cover part 140 and the second cover part 150 may be coupled by mutual spot welding before being coupled to the housing 110. As shown in FIG. 5, the first circumferential portion 141 and the second circumferential portion 151 are firmly fixed to each other by a plurality of spot welding portions 143 in a state where the second circumferential portion 151 is coupled to the outside of the first circumferential portion 141.

In a state where the first cover part 140 and the second cover part 150 are coupled to each other and the first circumferential portion 141 is inserted into the side surface portion 112 of the housing 110, an upper end of the side surface portion 112 of the housing 110 may be welded to an outer surface of the first circumferential portion 141 of the first cover part 140. The first circumferential portion 141 and the upper end of the side surface portion 112 of the housing 110 are continuously welded along the circumference so that the seal can be maintained.

As shown in FIG. 5, when the first circumferential portion 141 and the side surface portion 112 of the housing 110 are welded, an upper end of the fixing portion 122 of the membrane 120 and a lower end of the first circumferential portion 141 are spaced apart from each other by a predetermined spacing t1, and the upper end of the side surface portion 112 of the housing 110 and a lower end of the second circumferential portion 151 are also spaced apart from each other by a predetermined spacing t2. As such, when the fixing portion 122 and the first circumferential portion 141 are spaced apart from each other and the side surface portion 112 and the second circumferential portion 151 are spaced apart from each other, the occurrence of abnormal noise can be prevented since they are not interfered with each other when the membrane 120 vibrates.

Figure 6:
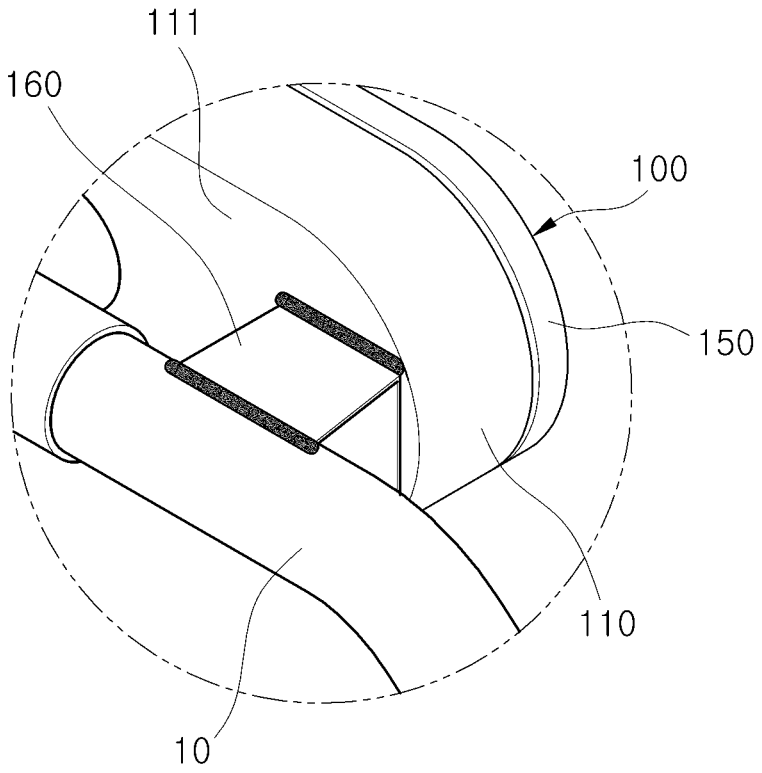
FIG. 6 is a perspective view illustrating a fixing member mounting structure of an exhaust sound generating apparatus according to an embodiment of the present disclosure.

At least one fixing member 160 may be installed between the bottom portion 111 of the housing 110 and the exhaust pipe 10. As shown in FIG. 6, the fixing member 160 may be welded to an outer surface of the exhaust pipe 10 at one side and welded to the bottom portion 111 of the housing 110 at the other side. When the fixing member 160 each is installed on both sides of the bottom portion 111 of the housing 110 as shown in FIGS. 3 and 4, the housing 110 can be firmly fixed to the exhaust pipe 10.

The exhaust sound generating apparatus 100 as above can prevent an exhaust sound transmitted to the outside from becoming excessively large even if the vibration of the membrane 120 increases momentarily because the membrane 120 is accommodated in the housing 110 and protected by the first and second cover parts 140 and 150.

Particularly, the exhaust sound generating apparatus 100 can prevent a coarse heterogeneous sound from being generated in a high frequency band.

Further, the exhaust sound generating apparatus 100 according to the present embodiment can protect the membrane 120 from external impacts (such as impact caused by stones bouncing off the road) when the vehicle is running and corrosion caused by rainwater, etc., because the membrane 120 is accommodated in the housing 110.

Further, the components of the exhaust sound generating apparatus 100 according to the present embodiment can be easily assembled because the fixing portion 122 of the membrane 120 and the side surface portion 112 of the housing 110 are coupled mutually by spot welding, the first cover part 140 and the second cover part 150 are fixed mutually by spot welding, and then the first circumferential portion 141 of the first cover part 140 and the side surface portion 112 of the housing 110 are welded mutually. In addition, the exhaust sound generating apparatus 100 manufactured by the manufacturing method as above can generate a good exhaust sound because the flat plate portion 121 of the membrane 120 is prevented from being deformed by welding heat.

As is apparent from the above, the exhaust sound generating apparatus of a vehicle according to an embodiment of the present disclosure can prevent the exhaust sound transmitted to the outside from becoming excessively large even when the vibration of the membrane is instantaneously increased and can prevent the generation of a coarse heterogeneous sound in a high frequency band because the membrane is accommodated in the housing and protected by the first and second cover parts.

The exhaust sound generating apparatus of a vehicle according to an embodiment of the present disclosure can protect the membrane from corrosion due to external impact, rainwater or the like because the membrane is accommodated in the housing and is covered with the first and second cover parts.

The components of the exhaust sound generating apparatus of a vehicle according to an embodiment of the present disclosure can be easily assembled because the fixing portion of the membrane and the side surface portion of the housing are coupled mutually by spot welding, the first cover part and the second cover part are fixed mutually by spot welding, and then the first circumferential portion of the first cover part and the side surface portion of the housing are welded mutually. In addition, the exhaust sound generating apparatus manufactured by the manufacturing method as above can generate a good exhaust sound because the flat plate portion of the membrane is prevented from being deformed by welding heat.

While a number of exemplary aspects have been discussed above, those of skill in the art will recognize that still further modifications, permutations, additions and sub-combinations thereof of the disclosed features are still possible. It is therefore intended that the following appended claims and claims hereafter introduced are interpreted to include all such modifications, permutations, additions and sub-combinations as are within their true spirit and scope.

What is claimed is:

1. An exhaust sound generating apparatus of a vehicle comprising:

a housing which has a connection flow passage connected to the exhaust pipe of a vehicle and is open on one surface;

a cover member covering the open portion of the housing; and a membrane positioned in an inside of the housing to partition the inside of the housing into a first space on the connection flow passage side and a second space on the cover member side, and vibrated by the pulsation of exhaust gas;

wherein the cover member comprises a first cover part covering the open portion of the housing and a second cover part covering an outside of the first cover part so as to form a space with the first cover part.

2. The exhaust sound generating apparatus according to claim 1, wherein the housing comprises a bottom portion provided with the connection flow passage and a side surface portion bent and extended toward the cover member from a circumference of the bottom portion.

3. The exhaust sound generating apparatus according to claim 2, wherein the membrane comprises a fixing portion coupled to a corresponding inner surface of the side surface portion of the housing and fixed to the inner surface of the side surface portion of the housing by spot welding at a plurality of points.

4. The exhaust sound generating apparatus according to claim 3, wherein the first cover part has a first circumferential portion that is inserted into an inside of the side surface portion of the housing and coupled to the housing; and wherein the second cover part has a second circumferential portion coupled to the outside of the first circumferential portion.

5. The exhaust sound generating apparatus according to claim 4, wherein the fixing portion of the membrane is spaced apart from the first circumferential portion, and the side surface portion of the housing is welded to an outer surface of the first circumferential portion of the first cover part in a state of being spaced apart from the second circumferential portion.

6. The exhaust sound generating apparatus according to claim 4, wherein the second circumferential portion is fixed to the first circumferential portion by spot welding at a plurality of points.

7. The exhaust sound generating apparatus according to claim 2, wherein the cover member comprises:

a first cover part covering the open portion of the housing and having a first circumferential portion that is inserted into an inside of the side surface portion of the housing and coupled to the housing; and a second cover part covering an outside of the first cover part so as to form a space with the first cover part and having a second circumferential portion coupled to the outside of the first circumferential portion.

8. The exhaust sound generating apparatus according to claim 7, wherein the side surface portion of the housing is welded to an outer surface of the first circumferential portion of the first cover part in a state of being spaced apart from the second circumferential portion.

9. The exhaust sound generating apparatus according to claim 2, further comprising at least one fixing member for connecting and fixing the bottom portion of the housing to the exhaust pipe.

* * * * *